United States Patent [19]

Schwend

[11] Patent Number: 4,838,057

[45] Date of Patent: Jun. 13, 1989

[54] COMBINATION DOOR LOCK

[75] Inventor: Fred N. Schwend, Mira Loma, Calif.

[73] Assignee: Francis R. Schwend, Santa Ana, Calif.

[21] Appl. No.: 162,217

[22] Filed: Feb. 29, 1988

[51] Int. Cl.[4] ..... E05B 13/00

[52] U.S. Cl. ..... 70/214; 70/298

[58] Field of Search ..... 70/214, 314, 220, 219, 70/213, 297, 298

[56] References Cited

U.S. PATENT DOCUMENTS

| | | | |
|---|---|---|---|
| 436,597 | 9/1890 | Deal | 70/214 |
| 684,082 | 10/1901 | Morse et al. | 70/220 |
| 1,448,888 | 3/1923 | Walters | 70/214 |
| 1,530,861 | 3/1925 | Standen | 70/298 |
| 1,792,949 | 2/1931 | Weissenboeck | 70/214 |
| 2,598,457 | 5/1952 | Capdevila | 70/314 X |
| 2,920,473 | 1/1960 | Hansen | 70/214 X |
| 3,226,963 | 1/1966 | Mathieu | 70/314 |
| 4,191,035 | 3/1980 | Hatch | 70/298 |
| 4,457,147 | 7/1984 | Cumpston | 70/213 |

FOREIGN PATENT DOCUMENTS

| | | | |
|---|---|---|---|
| 51206 | 1/1936 | Denmark | 70/298 |
| 48063 | 7/1937 | France | 70/298 |

*Primary Examiner*—Lloyd A. Gall

[57] ABSTRACT

A combination lock to be fitted in a door having standard size lock and bolt bores therein. A series of code pins extend through the lock bore and are movable between set and reset positions from both sides of the door to permit rotation of an exterior knob spindle to release the lock. An interior knob may be rotated to release the lock even though locked from the exterior. An adjustment feature selectively adjusts the lock to act as either a single lock or a double lock.

9 Claims, 2 Drawing Sheets

COMBINATION DOOR LOCK

BACKGROUND OF THE INVENTION

1. Field of the invention

This invention relates to combination locks and has particular reference to locks for use in doors, requiring proper setting of a series of code pins arranged around a knob spindle to enable release of the lock.

2. Description of the prior art

Examples of locks of the above type are disclosed in U.S. Pat. Nos. 436,597 to J. J. Deal; 1,530,361 to H. S. Standen; and 4,191,035 to G. Hatch.

Although such prior art locks obviate the need for using keys to release a lock, they present certain disadvantages which have precluded their widespread adoption heretofore, namely, in part, they cannot be released from inside a building while remaining locked from the outside. Also, in such prior art locks, the code pins, after being set to release the lock, must be reset by a subsequent manual operation so that the prescribed combination necessary to release the lock cannot be discerned by unauthorized persons. Further, none of such prior locks, to applicant's knowledge, can be mounted in doors having modern standard size bolt and lock openings therein without extensively changing or remortising of the door.

SUMMARY OF THE INVENTION

Accordingly, a principal object of the present invention is to provide a lock which overcomes the aforementioned disadvantages of prior combination door locks of the foregoing type.

Another object is to provide a combination door lock which can be readily changed from a single lock wherein the door can be locked to prevent opening from outside a room or building while permitting opening thereof from the inside, to a double lock wherein the door can be locked from being opened from both the outside and the inside.

Another object is to provide a lock of the above type which is inexpensive and easy to install in a door having standard bolt and lock bores therein.

BRIEF DESCRIPTION OF THE DRAWINGS

The manner in which the above and other objects of the invention are accomplished will be readily understood on reference to the accompanying drawings when read in conjunction with the following specification, wherein.

DESCRIPTION OF THE PREFERRED EMBODIMENT

Figure 1:
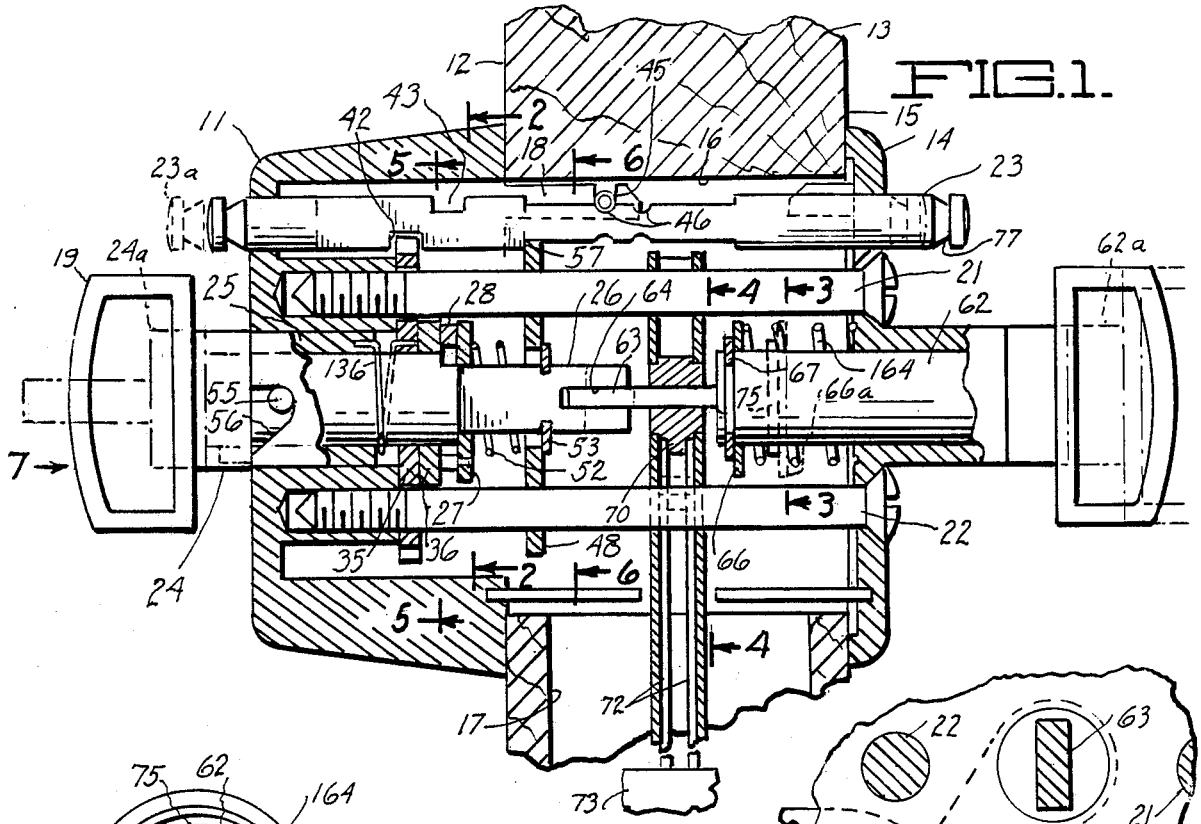
FIG. 1 is a sectional plan view of a combination door lock embodying a preferred form of the present invention and is taken along line 1—1 of FIG. 2.

While this invention is susceptible to embodiment in many different forms, there are shown in the drawings and will be described certain embodiments, with the understanding that the present disclosure is to be considered as an exemplification of the principles of the invention and is not intended to limit the invention to the embodiments illustrated. The scope of the invention will be pointed out in the appended claims.

Referring to FIGS. 1 to 6, the lock comprises an exterior housing part 11 for mounting on the exterior side 12 of a door 13, and an interior housing part 14 for mounting on the interior side of the door.

The door may be of conventional construction, having a transverse cylindrical lock bore 16 of standard size and a bolt bore 17 of standard size extending from the bore 16 to the front edge (not shown) of the door. A series of centering lugs 18 extend from the housing part 11 to locate the lock 11 in the bore 16.

A pair of clamp screws 21 and 22 are screw threaded into the housing part 11 to removably clamp the housing parts 11 and 14 to the respective sides of the door.

Figure 2:
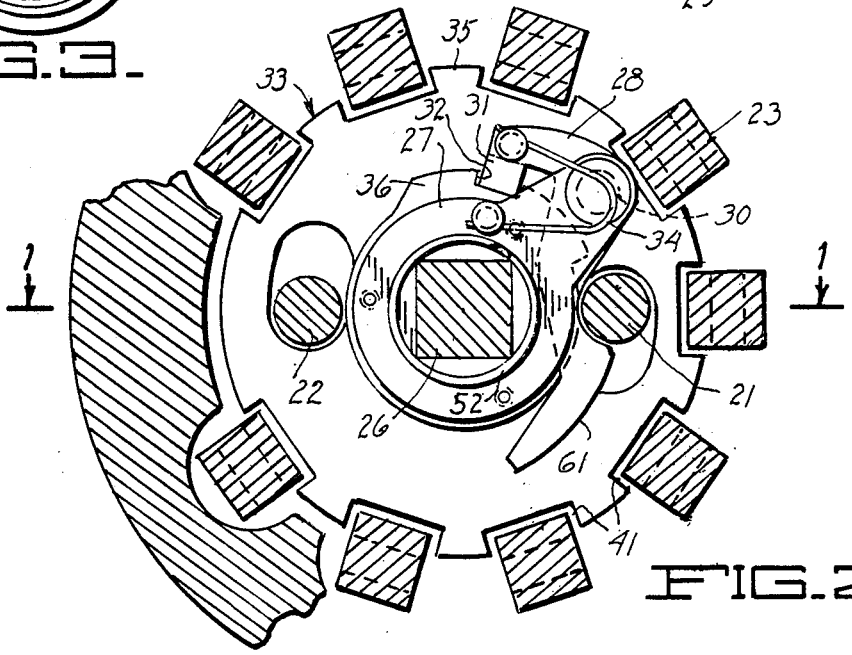
FIG. 2 is an enlarged transverse sectional view of the lock and is taken along line 2—2 of FIG. 1.
Figure 5:
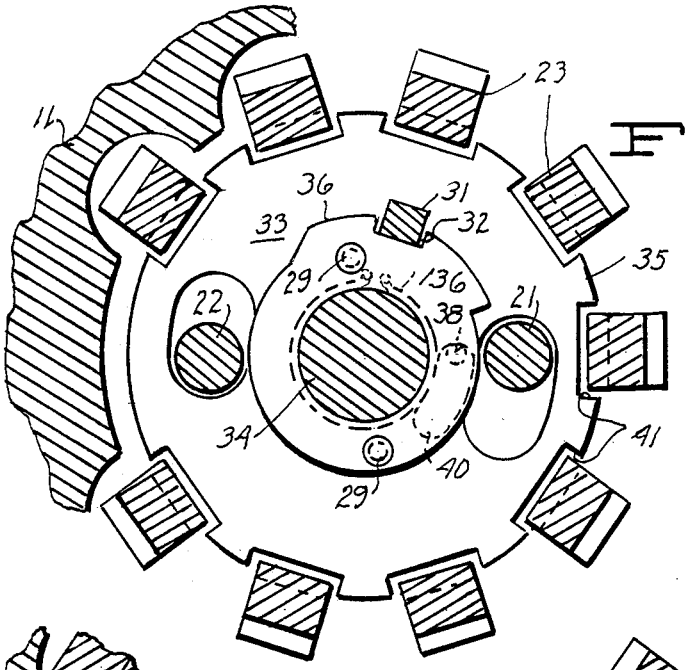
FIG. 5 is an enlarged transverse sectional view taken along line 5—5 of FIG. 1.
Figure 6:
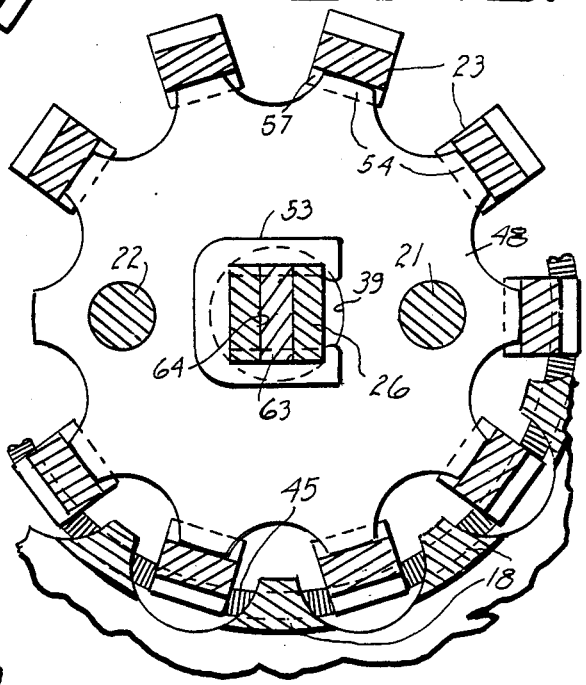
FIG. 6 is an enlarged transverse sectional view taken along line 6—6 of FIG. 1.

A series of code pins 23 are mounted in bearings formed in the housing parts 11 and 14 for axial and rotational settings. The pins are located at equal angular spacings about the axis of the lock, as seen in FIGS. 2,5 and 6, except for the exclusion of one such pin at the location of the bolt bore 17.

An exterior knob spindle 24 having a knob 19 thereon is mounted in a bearing 25 fixed in the exterior housing part 11 for both rotational and endwise movement. The spindle has a portion 26 of square cross section on which an arm 27 is splined (see also FIG. 2). A pawl 28 is pivoted at 30 on the arm 27 and is formed with an offset nose 31 which is normally engaged in a notch 32 formed in a ward member generally indicated at 33, by a hairspring 34 extending between the pawl and the arm 27. The ward member comprises a slotted ward plate 35 integrally united with a disc 36 in which the notch 32 is formed. Rivets 29 secure the plate 35 and, disc 36 together. The ward member 33 is free on the spindle 24 and is urged toward its position shown in FIGS. 2 and 5 by a torsion spring 136 extending between the bearing 25 and the ward member. The ward member is limited in such position, when released by the pawl 28, by a pin 38 carried by the housing part 11 and embraced by an arcuate slot 40 formed in the ward plate 35. Also, in such position, slots 41 in the ward plate 35 register with respective ones of the code pins 23 to permit the latter to be moved endwise between "set" positions shown in full lines in FIG. 1 and "reset" positions shown by dotted lines *3a*. Longitudinally spaced notches 42 and 43 are formed on opposite sides of the code pins and when a pin is rotatably set about its axis to its position shown in FIG. 1 and is located in its longitudinally "set" position, notch 42 will register with ward plate 35 enabling rotation of the ward plate by spindle 24 if otherwise allowed to do so. However, when the code pin 23 is moved longitudinally to its "reset" position it will block the ward member from rotation. On the other hand, when a code pin is rotatably set 180 degrees about its axis, from that shown in FIG. 1 and is moved axially to its "reset" position, its notch 43 will register with the ward plate 35 to free the same and when moved to its "set" position it will block the ward plate.

As will be described later, any of the code pins 23 may be rotatably set about their axes in accordance with a desired code combination to require appropriate setting and resetting thereof to permit rotation of the spindle 24 to release the lock.

The various pins 23 are detented in their set and reset positions by an endless garter spring 45 (FIGS. 1 and 6) which is fitted in notches in the lugs 18 and detents in one or the other of spaced grooves 46 in the pins 23.

An annular pin retractor plate 48 (FIGS. 1 and 6) is mounted over the portion 26 of spindle 24. A compression spring 52 is interposed between arm 27 and plate 48 to hold the plate against a shaft clip 53 and to normally hold the spindle in its inner position shown in full lines in FIG. 1. In such location, projections 54 on the plate 48 lie directly behind shoulders 57 of those code pins 23 which are in set positions. Also, in such position of the spindle 24 a camming pin 55 thereon rests at the bottom of a cam formation 56 formed in the bearing 25.

Upon appropriate setting of the pins 23 and rotation of the spindle 24, a camming tail 61 on the pawl 28 will engage the side of the clamp screw 21, thus rocking the pawl clockwise relative to the arm 27 to disengage its nose 31 from the notch 32 in the ward member 33. This will occur shortly after counterclockwise rotation of the ward member starts (but after the notches 41 in the ward plate have moved past the adjacent side edges of the respective pins 23), permitting spring 136 to return ward member 33 to its illustrated home position. Continued rotation of the spindle 24 to effect release of the lock will cause the pin 55 to ride up the cam formation 56, moving the spindle 24 endwise and causing the retractor plate 48 to move any of the pins 23 which are in set positions to their reset positions.

An interior knob spindle 62 is mounted for rotational and lengthwise movement in a bearing formed in the housing part 14, coaxial with the exterior spindle 24. The spindle 62 terminates in a flat blade 63 which normally fits in a slot 64 in the spindle 24 to form a driving connection between the two spindles 24 and 62.

A compression spring 164 is interposed between the housing part 14 and an annular ring 66 (see also FIG. 3) which normally rests against a shaft clip 67 secured to the spindle 62, thereby holding the spindle in its inner position shown in full lines in FIG. 1. In such position, the blade 63 fits in slot 64 to couple the spindles and is of such a length that it remains in coupling engagement with the spindle 24 when the latter is moved endwise to its dotted line position 24*a* as a result of the camming effect of the pin 55 as it rides over the cam formation 56 or by direct outward pulling of the spindle. Such outward movement is limited by collapsing of the spring 52.

The blade 63 is also splined to an arm 70 (see also FIG. 4) connected through a pin and slot connection 71 to links 72 to a door lock bolt partly shown at 73.

Considering this disclosure as being directed to a dead bolt type lock, the bolt 73 is movable into and out of locking engagement with a suitable strike plate (not shown) on the door frame. Thus, rotation of the spindle 62 through approximately 90 degrees will move the bolt 73 between locking and unlocking positions.

The blade 63 is of such length that when the spindle 62 is withdrawn to its dotted line position 62*a*, the blade will be withdrawn from the slot 64 in spindle 24, thus enabling the spindle 62 to be rotated to release the lock from the interior side of the door, even though the exterior spindle is blocked from rotation.

Figure 3:
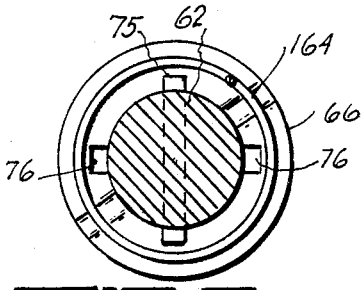
FIG. 3 is an enlarged transverse sectional view taken along line 3—3 of FIG. 1.
Figure 4:
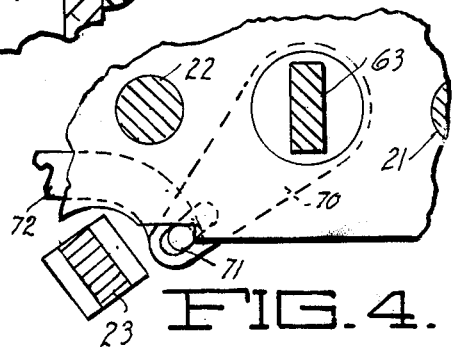
FIG. 4 is an enlarged fragmentary view taken along line 4—4 of FIG. 1.

Means are provided to change the lock into a double lock configuration wherein it cannot be released from either the interior or exterior of the door until the proper combination of pins is moved to set position. For this purpose, a pin 75 is secured to the spindle 62. The ring 66 is formed with diametrically opposed notches 76 which are normally located out of register with the pin 75 as seen in FIG. 3. However, by rotating the ring 66 until the notches 76 are aligned with the pin 75, the ring may be adjusted axially along the spindle 62 until it passes to the right of the pin, as indicated by dotted lines 66*a*, and then rotated a partial turn, to rest in such position, thereby collapsing the spring164 so that the spindle 62 can no longer be withdrawn to uncouple the spindles from each other.

Accordingly, the pins 23 must be appropriately set from either side of the door. For this purpose, grooves 77 are formed on the inner ends of the pins to facilitate manipulating the pins.

The above mentioned setting of the ring 66 as well as the rotational movement of the pins 23 about their axes to effect different appropriate combinations may be readily effected by disassemblying the housing part 14 from the door by removing the clamp screws 21 and 22.

DESCRIPTION OF THE MODIFIED EMBODIMENT

Figure 9:
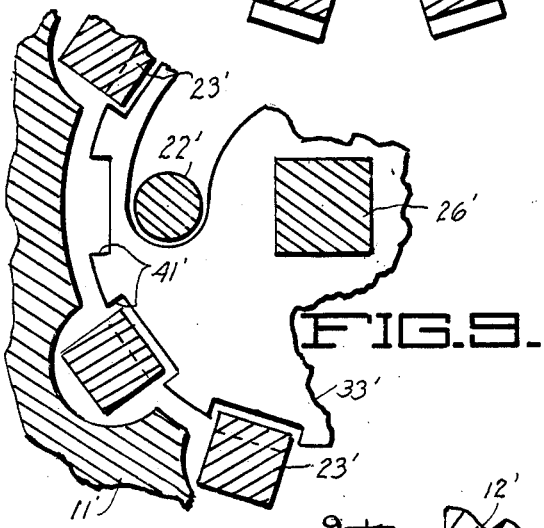
FIG. 9 is a fragmentary transverse sectional view taken along line 9—9 of FIG. 8.
Figure 8:
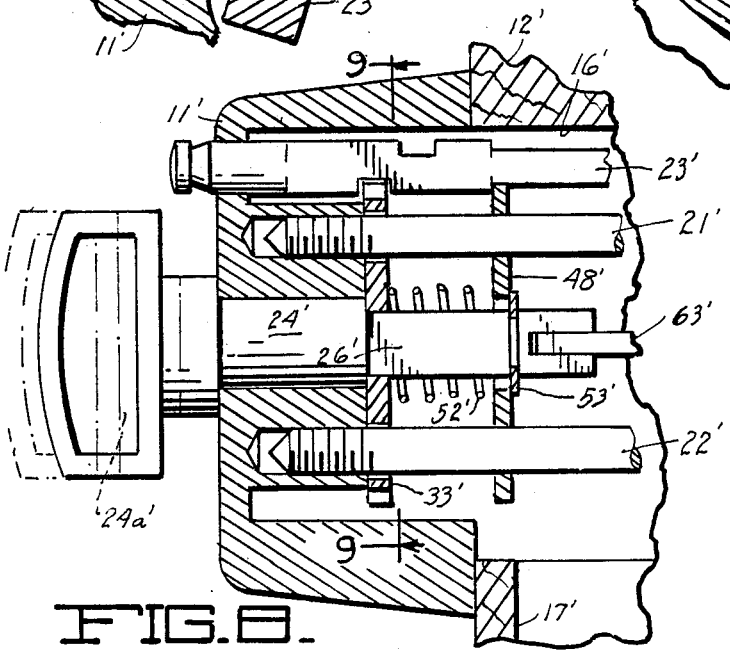
FIG. 8 is a sectional plan view, partly broken away, illustrating a modified form of the invention. Part of the lock shown in FIG. 8, which is broken away in that figure, contains mechanism similar to that disclosed at the right hand side of FIG. 1 and mechanism similar to that shown in FIG. 1 will be identified by similar reference characters.
Figure 7:
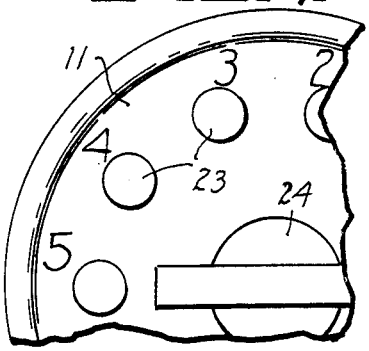
FIG. 7 is a front view, partly broken away, of the lock.

FIGS. 8 and 9 illustrate a modified form of the invention in which elements similar to those shown in FIGS. 1 to 7 are identified by similar primed reference numerals. Also, for the sake of brevity, parts broken away to the right of FIG. 8 are similar to those shown in the right hand part of FIG. 1.

It will be noted that in this modified form, the ward member 33′ comprises only a single plate which is directly splined to the square portion 26′ of the exterior spindle 24′ and is thus caused to rotate 90 degrees along with spindle 24′ when permitted to do so by appropriate setting of the pins 23′, thereby causing retraction of the lock bolt by rotating the interior knob spindle blade 63′.

The pin retractor plate 48′ is retained against shaft clip 53′ by compression spring 52′ which acts to hold the ward member 33′ against the inner surface of the housing part 11′ and also acts to normally hold the exterior knob spindle 24′ in its inner full line position of FIG. 8.

After rotating the spindle 24′ 90 degrees to release the lock, the spindle 24′ may be withdrawn endwise to its dotted line position 24*a*′ causing the retractor plate 48′ to return any set pins 23′ to their reset positions so that the appropriate combination will not become apparent to unauthorized persons.

I claim:

1. In a door lock:

exterior and interior housing parts for mounting on respective interior and exterior sides of a door, an exterior knob spindle rotatably supported by said exterior housing part, a ward member rotatable from a home position by said spindle, a plurality of pins supported for endwise movement between set and reset positions, certain of said pins having notches registerable with said ward member only when said certain pins are in set positions whereby to free said ward member and others of said pins having notches registerable with said ward member only when said other pins are in reset positions whereby to free said ward member, a pin retractor member carried by said spindle for movement endwise of said pins, and means responsive to rotation of said spindle for moving said spindle endwise to cause said retractor member to move set ones of said pins to reset positions.

2. A door lock as defined in claim 1 wherein said last mentioned means comprises a camming device operable by said spindle.

3. A door lock as defined in claim 1 wherein said ward member is rotatably mounted on said spindle, means comprising a pawl carried by said spindle for rotating said ward member from said home position, means responsive to rotation of said spindle for releasing said pawl after said ward member rotates from said home position, and means for returning said ward member to said home position independently of said spindle.

4. A door lock as defined in claim 3 wherein said last mentioned means comprises spring means.

5. A door lock as defined in claim 3 wherein said pawl releasing means comprises means on said pawl engagable with part of said lock after said ward member rotates from said home position when said ward member is rotated by said spindle.

6. A door lock as defined in claim 3 comprising an interior knob spindle rotatably supported by said interior housing part coaxially of said exterior spindle, a door lock bolt, means operable by said interior spindle upon rotation for moving said bolt between door locking and unlocking positions, and means for selectively coupling and uncoupling said spindles.

7. A door lock as defined in claim 3 comprising an interior door knob spindle rotatably supported by said interior housing part coaxially of said exterior spindle, a door lock bolt, means operable by said interior spindle upon rotation for moving said bolt between door locking and unlocking positions, a coupling device for coupling said spindles for conjoint rotation, said coupling device being uncoulled by axial movement of said interior spindle whereby said interior spindle may be rotated independently of said exterior spindle.

8. A door lock as defined in claim 7 comprising spring means for normally maintaining said coupling device effective.

9. A door lock comprising exterior and interior housing parts for mounting on respective exterior and interior sides of a door, an exterior knob spindle rotatably supported by said exterior housing part, a ward member rotatable from as home position by said spindle, a plurality of pins supported for endwise movement between set and reset positions, certain of said pins having notches registerable with said ward member only when said certain pins are in set positions whereby to free said ward member and others of said pins having notches registerable with said ward member only when said other pins are in reset positions whereby to free said ward member, said pins extending through the door and the exterior and interior housing parts an interior knob spindle rotatably supported by said interior housing part coaxially of said exterior spindle, a door lock bolt, means operable by said interior spindle upon rotation for moving said bolt between door locking and unlocking positions, said interior spindle being axially movable toward and away from coupling engagement with said exterior spindle, means normally maintaining said interior spindle in coupling engagement with said exterior spindle in coupling engagement with said exterior spindle, and means for selectively preventing said interior spindle from moving out of said coupling engagement.

* * * * *

UNITED STATES PATENT AND TRADEMARK OFFICE

CERTIFICATE OF CORRECTION

PATENT NO. : 4,838,057

DATED : June 13, 1989

INVENTOR(S) : Fred N. Schwend

It is certified that error appears in the above-identified patent and that said Letters Patent is hereby corrected as shown below:

Column 6, line 10, "uncoulled" should read -- uncoupled --.

Column 6, lines 44 and 45, delete "in coupling engagement with said exterior spindle"

Signed and Sealed this

Twenty-first Day of November, 1989

*Attest:*

JEFFREY M. SAMUELS

*Attesting Officer*

*Acting Commissioner of Patents and Trademarks*